United States Patent [19]

McDonie

[11] 4,305,972

[45] Dec. 15, 1981

[54] METHOD FOR EXPEDITIOUSLY PROCESSING A SODIUM-POTASSIUM-CESIUM-ANTIMONY PHOTOCATHODE

[75] Inventor: Arthur F. McDonie, Lancaster, Pa.

[73] Assignee: RCA Corporation, New York, N.Y.

[21] Appl. No.: 164,676

[22] Filed: Jun. 30, 1980

[51] Int. Cl.[3] ..... H01J 1/34; B05D 1/36

[52] U.S. Cl. ..... 427/10; 427/74

[58] Field of Search ..... 427/74, 166, 10

[56] References Cited

U.S. PATENT DOCUMENTS

| | | | |
|---|---|---|---|
| 2,676,282 | 4/1954 | Polkosky | 313/102 |
| 2,770,561 | 11/1956 | Sommer | 427/74 X |
| 3,023,131 | 2/1962 | Cassman | 427/75 |
| 3,372,967 | 3/1968 | Hughes | 316/5 |
| 3,434,876 | 3/1969 | Stoudenheimer et al. | 427/74 X |
| 3,498,834 | 3/1970 | Rome et al. | 427/75 |
| 3,658,400 | 4/1972 | Helvy | 427/69 X |

OTHER PUBLICATIONS

Sommer, *Photoemissive Materials,* John Wiley & Sons, Inc., New York, 1968, pp. 114–124.

*Primary Examiner*—James R. Hoffman

*Attorney, Agent, or Firm*—Eugene M. Whitacre; Dennis H. Irlbeck; Vincent J. Coughlin, Jr.

[57] ABSTRACT

A method is provided for making a photocathode including the step of forming a base layer including antimony on a substrate. Sodium is then evaporated at an elevated temperature onto the base layer such that the sensitivity increases to a value which is less than a peak value. At an intermediate temperature potassium is evaporated to a first peak value of sensitivity. Antimony and potassium are alternately evaporated until a second peak value of sensitivity is achieved. At the above-mentioned intermediate temperature, cesium is evaporated to a third peak value of sensitivity. Antimony and cesium are alternately evaporated until a fourth peak value of sensitivity is attained. The photocathode is slow cooled from the intermediate temperature to a second intermediate temperature at which point the cooling rate is increased in order to permit the photocathode to reach room temperature.

7 Claims, 2 Drawing Figures

METHOD FOR EXPEDITIOUSLY PROCESSING A SODIUM-POTASSIUM-CESIUM-ANTIMONY PHOTOCATHODE

BACKGROUND OF THE INVENTION

This invention relates to photocathodes and more particularly to a method for expeditiously forming a high sensitivity sodium-potassium-cesium-antimony photocathode.

The sodium-potassium-cesium-antimony photocathode, or S-20 photocathode, is well known in the art. For example, the details of a typical S-20 photocathode process are disclosed by A. H. Sommer in *Photoemissive Materials,* John Wiley and Sons, Inc., New York, 1968, pages 114–124. As described by Sommer, the formation of an S-20 photocathode requires a complex sequence of processing steps including as many as 50 or more antimony-potassium alternations as well as a large number ofdf antimony-cesium alternations which are time consuming and thus costly.

A modification of this process is described in U.S. Pat. No. 2,770,561 issued to A. H. Sommer on Nov. 13, 1956 and entitled, "Photoelectric Cathode and Method of Producing Same." The S-20 photocathode disclosed in the Sommer patent differs from the S-20 photocathode disclosed in the latter published Sommer article in that the patented photocathode process initially deposits sodium metal on an antimony film until peak photosensitivity is achieved. While the Sommer's patent also eliminates the antimony-potassium and the antimony-cesium alternations, thus providing a faster process than that described in the Sommer article, the resulting photocathode is disclosed to have a sensitivity of approximately 100 microamperes per lumen and thus unacceptable low in sensitivity for most photomultiplier tube applications.

Increases in S-20 photocathode sensitivity were reported by F. R. Hughes in U.S. Pat. No. 3,372,967 issued on Mar. 12, 1968 and entitled, "Method of Making a Multi-Alkali Cathode" and by F. A. Helvy in U.S. Pat. No. 3,658,400 issued on Apr. 25, 1972 and entitled, "Method of Making a Multialkali Photocathode With Improved Sensitivity to Infrared Light and a Photocathode Made Thereby".

The Hughes patent discloses that a combined source of potassium and sodium may be contained within a single channel so that potassium and sodium may be co-evaporated from the source onto a substrate having an antimony layer thereon. A limitation of the Hughes patent includes the difficulty in achieving high reproducibility of photocathode sensitivity due to the wide variation allowed for the amount of sodium tungstate compared to the amount of potassium chromate. A further limitation of the Hughes patent is the generally low photocathode sensitivity reported (about 140 microamperes per lumen).

The Helvy patent which discloses the simultaneous evaporation of sodium and antimony followed by the simultaneous evaporation of potassium and antimony provides a highly reproducible photocathode having an extended red response greater than the red response achieved by using either the Sommer or the Hughes process; nevertheless, the Helvy process requires a highly skilled cathode processing operator to properly perform the simultaneous evaporation steps.

In each of the above-described references sodium is evaporated either to a peak sensitivity or an excess amount of sodium is provided so that the sensitivity reaches a peak and decreases to less than the peak value. It is generally believed that the chemical composition of an S-20 photocathode having optimum sensitivity requires a two to one ratio of sodium to potassium so that the photocathode has a stoichiometric formula $(Cs)Na_2KSb$ (see Sommer, Photoemissive Materials, pages 114–124).

SUMMARY OF THE INVENTION

A method is provided for making a photocathode including the step of forming a base layer including antimony on a substrate. Sodium is then evaporated onto the base layer such that the sensitivity increases to a value which is less than a peak value. Potassium is subsequently evaporated to a first peak value of sensitivity followed by alternately evaporating antimony and potassium to a second peak value of sensitivity. Next cesium is evaporated to a third peak value of sensitivity. Antimony and cesium are alternately evaporated onto the previously evaporated cesium until a fourth sensitivity peak is achieved.

DETAILED DESCRIPTION OF THE PREFERRED EMBODIMENT

Figure 1:
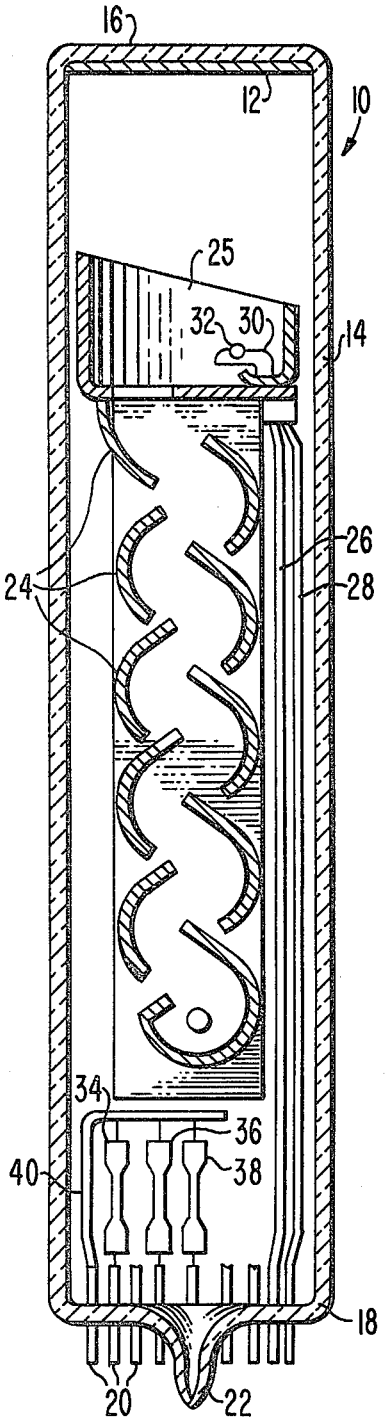
FIG. 1 is a sectional view of a phototube having a photocathode formed in accordance with the present method.

In FIG. 1 of the drawing there is shown a photomultiplier tube 10 comprising a photocathode 12. The photomultiplier tube 10 is utilized herein by way of example, it being understood that any photosensitive device incorporating a photocathode may be used. The tube 10 has a tubular glass envelope 14 closed at one end by a substantially flat, transparent glass faceplate 16. The photocathode 12 is formed on the faceplate 16. The other end of the envelope 14 is closed by a glass stem 18 having a number of electrical lead-on pins 20 and an exhaust tubulation 22, shown as being "tipped-off". Along the interior of the tube are spaced a series of dynodes 24 disposed adjacent to an aperture cup 25. The dynodes 24 may be formed of copper-beryllium, nickel, or molybdenum composition.

Mounted near the dynodes 24 are nickel wires 26 and 28. The nickel wires 26 and 28 are connected to a platinum-clad molybdenum wire filament 10 to which is attached a bead 32 of an antimony-platinum alloy comprising about 50% antimony and 50% platinum, by weight.

Also mounted within the envelope 14 adjacent to the dynodes 24 are three channels 34, 36, and 38 of tantalum foil containing, respectively, substances for evaporating sodium, potassium and cesium. The sodium channel 34 contains sodium chromate, zirconium and tungsten. The potassium channel 36 contains potassium chromate, zirconium and tungsten. The cesium channel 38 contains cesium chromate, zirconium and tungsten. A nickel wire 40 is connected to one end of each of the channels 34, 36, and 38. The other end of each of the channels 34, 36, 38, and the nickel wires 26, 28 and 40 are attached to a different one of the lead-in pins 20. Electrical current sources (not shown) are provided to pass a current through the pins 20 so that the bead 32 and the channels 34, 36 and 38 can be activated by electrical resistance heating.

Figure 2:
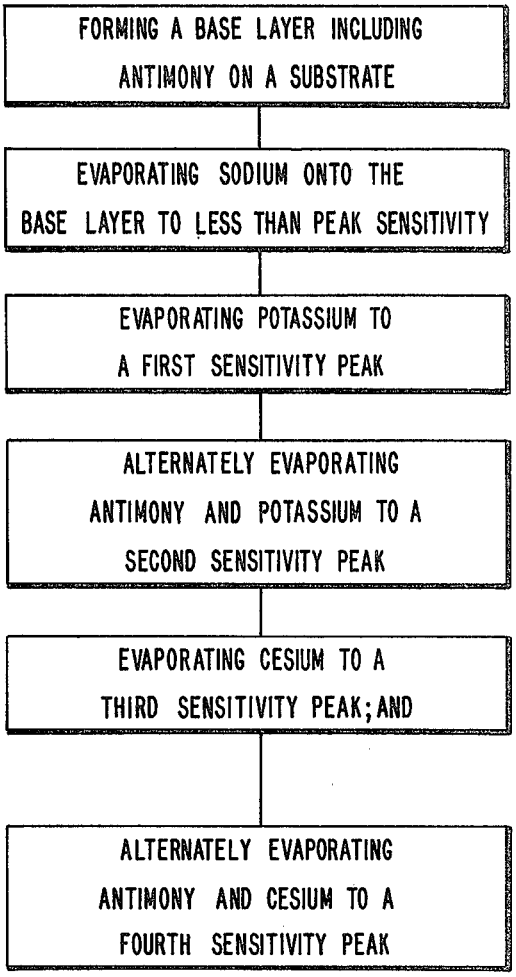
FIG. 2 is a flow chart showing the steps in the formation of the photocathode of FIG. 1.

The photocathode 12 is made in accordance with the following procedure, which is summarized in the flowchart shown in FIG. 2. The exhaust tubulation 22 is connected, prior to tip-off, to an exhaust system (not shown) and the tube envelope 14 is evacuated until the pressure in the envelope 14 is of the order of $10^{-6}$ Torr or less. The tube 10 is then baked between 375°–400° C. for about 2 hours to remove occluded gases from the interior tube components. The tube 10 is then cooled at 5°–10° C. per minute to room temperature.

At room temperature (about 23° C.) antimony is evaporated onto the faceplate from the platinum-antimony bead 32 and the transmission is reduced from 100 percent down to about 90 percent of the original value of 100 percent. In order to measure the amount of material deposited on the faceplate 16, light transmission can be measured in the manner disclosed in U.S. Pat. No. 2,676,282 to Polkosky issued on Apr. 20, 1954 and incorporated by reference herein. A light indicator (not shown) can be set to show a scale reading of 100 at full transmission of light through the faceplate 16. Evaporation of antimony is continued until the transmission through the faceplate is 90 percent of its original value of 100 percent.

Oxygen is next introduced into the envelope 14 through the exhaust tubulation 22 to a pressure of about 300–380 microns. The antimony film is then oxidized by using a high frequency electrode (not shown) placed over the faceplate 16. The high frequency of the electrode produces within the envelope 14 a gaseous discharge which causes the antimony to react with the oxygen in the envelope 14. The electrode is held over the faceplate for about 5 to 20 seconds. This method of oxidizing metal films within the envelope is well-known and completely described in U.S. Pat. No. 2,020,305 To Essig issued on Nov. 12, 1935. The oxygen within the envelope is removed and the light transmission indicator is reset to 100.

Antimony from the platinum-antimony bead 32 is again evaporated onto the faceplate and the transmission, which was reset to 100 is reduced from 100 percent down to 70 percent. At the termination of the second antimony evaporation, a total reduction in transmission of about 63 percent has occurred.

The photoemissive sensitivity of the photocathode 12 is monitored by collecting the emitted photoelectrons with one or more of the internal electrodes, such as the aperture cup 25. Such monitoring techniques are well known in the art and need not be described. The sensitivity of the photocathode is expressed in terms of microamperes of emitted electron current per lumen of light incident on the photocathode 12; however, a calibrated light source is not used during cathode processing since the elevated processing temperatures cause the light to drift from its room temperature setting. Thus, an arbitrary value of light level may be used during processing. The arbitrary value of the processing light source is about 0.1 to 0.2 lumen.

The activation of the antimony film on the faceplate 16 is preceded by heating the tube 10 in an oven (not shown) until the faceplate 16 is raised to a temperature of between 240° to 250° C.

The channel 34 containing the sodium source is then heated by applying an electrical current through the channel 34 and the wire 40 in a method well known in the art. The current through the sodium channel 34 is gradually increased until the sodium source vaporizes. The current is then held constant and the sensitivity is monitored. When the sensitivity of the photocathode increases to a value that ranges from 50 to 80 percent of the expected peak value, the sodium evaporation is terminated. It has been determined that for the RCA 8644 tube structure shown in FIG. 1 the peak value of sensitivity during the abovedescribed sodium evaporation is typically 0.2 microampere. Thus, the present novel method provides for the termination of the sodium evaporation at a sensitivity value ranging from about 0.08 to 0.11 microampere. It is believed that by evaporating sodium as the initial alkali material, at a temperature considerably in excess of the prior art suggested sodium activation temperature of about 220° C., a sufficient amount of sodium is introduced into the cathode to subsequently provide the required stoichiometric ratio of two parts sodium to one part potassium. Furthermore the evaporation of sodium prior to the evaporation of potassium, and the evaporation of sodium to less than a peak value of sensitivity saves considerable processing time.

Subsequent to the evaporation of sodium, the tube temperature is reduced to about 180° C. This temperature is maintained during the several steps of evaporating potassium, cesium and antimony to be described.

The channel 36 containing the potassium source is then heated in the manner previously described for the heating of the sodium channel 34. The heating is continued until the potassium vapors react with the sodium-antimony surface to provide a peak value of sensitivity. When the peak is achieved the current to the potassium channel is turned off and the antimony bead 32 is activated. Antimony is evaporated onto the photocathode 12 until the sensitivity is reduced from the peak value to about 10 percent of the peak value. Antimony and potassium are alternately evaporated onto the photocathode 12 with each successive potassium evaporation producing a higher value of sensitivity than the previous potassium evaporation. The alternate evaporations are continued until a second peak value of sensitivity, which is greater than the first peak value, is obtained. The presence of the second peak is a confirmed when a subsequent potassium alternation provides a value of potassium sensitivity less than the previous value of potassium sensitivity.

The channel 38 containing the cesium source is then heated in the manner described above for the potassium channel 36 and the sodium channel 34. The heating is continued until the cesium vapors react with the sodium-potassium-antimony surface to provide a peak value of sensitivity which is greater than the previously obtained sensitivity peaks. When the peak value of cesium sensitivity is achieved the current to the cesium channel 38 is turned off and the antimony bead 32 is activated. Antimony is evaporated on the photocathode 12 until the sensitivity is reduced from the most recently achieved peak value to about 50 percent of that peak value. Antimony and cesium are alternately evaporated onto the photocathode 12 with each successive cesium evaporation producing a higher value of sensitivity than the previous cesium evaporation. The alternative evaporations are continued until a fourth peak value of sensitivity is achieved. The presence of the fourth peak is confirmed by noting when a cesium alternation provides a value of sensitivity less than that achieved on the previous cesium alternation.

When the fourth sensitivity peak is achieved the current through the cesium channel 38 is turned off and the tube is slowly cooled from 180° C. to about 100° C. at a rate of about 5° C. per minute. When the tube temperature reaches 100° C. the tube may be freely cooled to room temperature.

Photocathodes formed by the present novel method may be processed in about a maximum of 60 minutes, exclusive of the initial bake time, as compared to typically about 90 to 120 minutes for the prior art processes. The photocathode sensitivity of tubes produced by the present method typically range from about 200 to 250 microamperes per lumen. This high value of sensitivity indirectly confirms that despite the abbreviated sodium step of the present method the stoichiometric ratio of two parts sodium to one part potassium has been achieved.

What is claimed is:

1. A method of making a photocathode comprising in order:

(a) forming a base layer including antimony on a substrate, (b) depositing sodium onto said base layer thereby forming a sodium-antimony surface such that the photomissive sensitivity increases to a value which is less than a peak value, (c) depositing potassium onto said sodium-antimony surface to a first peak value of photoemissive sensitivity thereby forming a sodium-potassium-antimony surface, (d) alternately depositing antimony and potassium onto said sodium-potassium-antimony surface until a second peak value of photoemissive sensitivity is reached, (e) depositing cesium onto said sodium-potassium-antimony surface to a third peak value of photoemissive sensitivity thereby forming a sodium-potassium-cesium-antimony photocathode, and (f) alternately depositing antimony and cesium onto said photocathode until a fourth peak value of photoemissive sensitivity is achieved.

2. The method as in claim 1 wherein the step of forming the base layer includes:

i. heating said substrate, in vacuum, for about 2 hours to a temperature of about 375°–400° C., ii. cooling said substrate to about room temperature, iii. depositing a first antimony layer on said substrate with a light transmission therethrough of 90 percent, iv. oxidizing said antimony layer to form an antimony oxide film, v. depositing a second antimony layer on said antimony oxide film with a total light transmission through said substrate, said antimony oxide film and said second antimony layer of 63 percent.

3. The method as in claim 1 wherein said substrate is maintained at a temperature of between 240° to 250° C. during step b.

4. The method as in claim 1 wherein said sodium photoemissive sensitivity is about 0.8 to 0.11 microamperes per unit of light incident on said photocathode.

5. The method as in claim 1 said substrate is maintained at a temperature of about 180° C. during steps c through f.

6. The method as in claim 5 further including the steps of:

i. cooling said substrate from the temperature at which the above step f is carried out, said cooling being at a rate of about 5° C. per minute to a temperature of approximately 100° C., and ii. freely cooling said substrate to room temperature.

7. The method as in claim 1, wherein said steps b through f are performed while said photocathode is illuminated by a light source of about 0.1 to 0.2 lumens.

* * * * *

UNITED STATES PATENT AND TRADEMARK OFFICE
CERTIFICATE OF CORRECTION

PATENT NO. : 4,305,972

DATED : December 15, 1981

INVENTOR(S) : Arthur Frederick McDonie

It is certified that error appears in the above-identified patent and that said Letters Patent is hereby corrected as shown below:

Column 1, line 20, change "ofdf to -- of --.

Column 2, line 51, change "10" to -- 30 --.

Signed and Sealed this

*Seventeenth* Day of *August 1982*

[SEAL]

*Attest:*

GERALD J. MOSSINGHOFF

*Attesting Officer*

*Commissioner of Patents and Trademarks*